US007322054B2

(12) United States Patent
Bush

(10) Patent No.: US 7,322,054 B2
(45) Date of Patent: Jan. 29, 2008

(54) AUTOMATIC TOILET FLUSHING SYSTEM AND METHOD

(75) Inventor: Shawn D. Bush, Oviedo, FL (US)

(73) Assignee: I-CON Systems, Inc., Oviedo, FL (US)

( * ) Notice: Subject to any disclaimer, the term of this patent is extended or adjusted under 35 U.S.C. 154(b) by 333 days.

(21) Appl. No.: 10/893,741

(22) Filed: Jul. 16, 2004

(65) Prior Publication Data

US 2006/0010591 A1 Jan. 19, 2006

(51) Int. Cl.
*E03D 5/10* (2006.01)

(52) U.S. Cl. ..... 4/406

(58) Field of Classification Search ..... 4/313, 4/406

See application file for complete search history.

(56) References Cited

U.S. PATENT DOCUMENTS

| | | | | |
|---|---|---|---|---|
| 2,061,310 | A * | 11/1936 | Kleiser, Jr. | 4/406 |
| 4,141,091 | A | 2/1979 | Pulvari | |
| 4,309,781 | A | 1/1982 | Lissau | |
| 4,941,215 | A * | 7/1990 | Liu | 4/406 |
| 5,003,643 | A | 4/1991 | Chung | |
| 5,169,118 | A | 12/1992 | Whiteside | |
| 5,228,146 | A | 7/1993 | Martell | |
| 5,482,250 | A | 1/1996 | Kodaira | |
| 5,603,127 | A | 2/1997 | Veal | |
| 5,901,384 | A | 5/1999 | Sim | |
| 6,161,814 | A | 12/2000 | Jahrling | |
| 6,202,227 | B1 | 3/2001 | Gurowitz | |
| 6,263,519 | B1 | 7/2001 | Parsons et al. | |
| 6,499,152 | B2 | 12/2002 | Johnson | |
| 6,618,864 | B2 | 9/2003 | Veal | |
| 7,032,256 | B2 * | 4/2006 | Contadini | 4/406 |
| 2002/0092090 | A1 | 7/2002 | Johnson | |
| 2002/0162166 | A1 | 11/2002 | Saar et al. | |

* cited by examiner

*Primary Examiner*—Charles E. Phillips
(74) *Attorney, Agent, or Firm*—The Webb Law Firm

(57) ABSTRACT

A toilet (10) having an automatic flush assembly (50) includes a toilet bowl (14), a water holding tank (12) for supplying water to the toilet bowl (14), and a flush valve (22). The holding tank (12) supplies water to the toilet bowl (14) and defines a handle opening (34) for an actuating handle (36) of the toilet (10). The flush valve (22) provides fluid communication between the toilet bowl (14) and the holding tank (12). The automatic flush assembly (50) is mounted in the handle opening (34) and includes a sensor section (54), a control section (56), and an actuating mechanism (58). The sensor section (56) detects the presence of a person in front of the toilet bowl (14). The control section (56) receives a detection signal from the sensor section (54) and initiates a flush signal to the actuating mechanism (58), which actuates the flush valve (22).

27 Claims, 10 Drawing Sheets

AUTOMATIC TOILET FLUSHING SYSTEM AND METHOD

BACKGROUND OF THE INVENTION

1. Field of the Invention

The present invention relates to toilets and, more particularly, to automatic flush toilets adapted for use in private residences. Further, the present invention relates to automatic flushing systems and assemblies for retrofitting bowl-type toilets typically found in private residences.

2. Description of Related Art

Automatic flushing systems are now well-known and widely used in commercial and industrial settings. Typically, an automated flushing system will cause the automatic flushing of a toilet or urinal after a user leaves the immediate proximity of the toilet or urinal. These types of devices are now commonly found in hotels, airports, sport stadiums, and other similar public facilities.

Most commercially available automatic flushing systems are designed for use with diaphragm-type flush valves that incorporate a diaphragm made of molded rubber, which effectuates water flow from a water inlet, through the flush valve, and to a water outlet. Often, the commercially available automatic flushing systems known in the art are adapted to retrofit into the orifice that accepts the actuation handle of the flush valve. The automatic flushing systems known in the art use a beam of radiation, such as infrared radiation, directed to an area in front of the toilet or urinal. The radiation beam is interrupted and reflected by the user of the toilet or urinal. The interruption and/or reflection of the radiation beam is transmitted as an input signal to a control device of some type. The control device then initiates a flush signal to a flush mechanism or device, such as a solenoid, which actuates the flush valve and flushes the toilet or urinal.

Typically, such automatic flushing systems used in commercial and industrial settings are complex and costly. Additionally, automatic flushing systems intended for use in commercial and industrial settings are designed for use only with flush valves having a diaphragm within the valve body. Such diaphragm-type flush valves are not typically found in private residences. Typically, private residences have bowl-type toilets that incorporate a ball cock, flapper valve, or other similar type of flush valve that is opened manually by a lever attached to a chain. Accordingly, automatic flushing systems intended for use in commercial or industrial settings are not typically amenable to use in private residences. Examples of automatic flushing systems intended for use in commercial and industrial settings are disclosed by U.S. Pat. Nos. 6,161,814; 5,169,118; and 4,309,781, all assigned to the Sloan Valve Company.

An automatic flushing system adapted specifically for use with bowl-type toilets typically found in private residences would be advantageous for several reasons. For example, individuals suffering from temporary or permanent disabilities would be relieved of reaching for the toilet handle, which is usually located a significant depth rearward of the toilet seat. Additionally, forgetfulness or lack of attentiveness on the part of impaired individuals, young children, or older persons would be corrected by the installation of an automatic flushing system. Further, an automatic flushing system for a bowl-type toilet would increase the cleanliness of in-home toilets by ensuring that the toilets were flushed after each use.

Moreover, conventional bowl-type toilets are still found in many commercial settings, such as restaurants. Many government regulations now require such facilities to meet certain health standards. A quick and convenient way of adapting an automatic flushing system to bowl-type toilets located in such settings would be particularly useful to, for example, restaurant owners. In particular, a retrofit automatic flushing system for use in such commercial settings would be a substantial cost savings for owners of facilities having older style bowl-type toilets compared with the cost of installing a completely new toilet fixture.

Automatic flushing systems for bowl-type toilets are known in the art. For example, U.S. Pat. No. 6,618,864 to Veal discloses an automatic flush and seat raising arrangement for a bowl-type toilet that includes an automatic flush device mounted to an overflow pipe within a water holding tank of the toilet. U.S. Pat. No. 6,202,227 to Gurowitz discloses an automatic toilet flushing system comprised of a replaceable water holding tank lid that carries the components of the automatic toilet flushing system. U.S. Pat. No. 5,901,384 to Sim discloses an automatic flushing system for bowl-type toilets that includes a motion sensor that attaches directly to the water holding tank of the toilet. The motion sensor is attached to the lip of the water holding tank and is operatively connected to a lifting member that opens a flapper valve located within the water holding tank of the toilet. U.S. Pat. No. 5,603,127 to Veal (hereinafter "the Veal '127 patent") discloses a similar automatic toilet flushing system to that disclosed by Sim, but uses infrared beams that are reflected by a user of the toilet. The automatic toilet flushing system disclosed in the Veal '127 patent is also mounted on the lip of the water holding tank of the toilet.

U.S. Pat. No. 5,003,643 to Chung discloses a flush controller for a bowl-type toilet that is mounted on top of the water holding tank lid. The flush controller disclosed by Chung includes an infrared device that sends an infrared beam to the area in front of the toilet bowl and receives a reflected infrared beam when a user enters the area in front of the toilet bowl. U.S. Pat. No. 4,941,215 to Liu discloses an automatic toilet flushing system for a bowl-type toilet, wherein activation of the flush valve is accomplished by a solenoid that effects vertical movement of a plunger rod. Further, U.S. Pat. No. 4,141,091 to Pulvari discloses an automatic toilet flushing system actuated by ultrasonic radiation rather than infrared radiation.

As may be seen from the foregoing, attempts have been made in the art to apply automatic flushing technology to bowl-type toilets, which are commonly found in private residences. The attempts made so far in the art have not truly reduced the costs associated with applying an automatic flushing system to a bowl-type toilet. Typically, the approaches taken in the art have included replacing the entire water holding tank lid with a new lid incorporating the components of the automatic flushing system. Additionally, some of the references discussed previously require the person performing the retrofit to locate the components of the automatic flushing system within the confines of the water holding tank, which is an unpleasant task for some homeowners. Further, the skills necessary to retrofit such bowl-type toilets are often beyond those of typical homeowners, and could require the homeowner to contract with a plumber to perform the necessary retrofit.

SUMMARY OF THE INVENTION

In view of the foregoing, a need exists for an automatic flush toilet adapted specifically for in-home use. Additionally, a need exists for an automatic toilet flushing system that is adapted specifically for conventional bowl-type toilets having an upstanding water chest. Further, a need exists for applying the automatic toilet flushing system to existing bowl-type toilets found in private residences. Moreover, a need exists for an automatic toilet flushing system that is simple to retrofit into an existing bowl-type toilet with little or no plumbing expertise.

The foregoing needs are fulfilled with an automatic flush toilet and automatic flush assembly in accordance with the present invention. The automatic flush toilet of the present invention encompasses conventional bowl-type toilets having a water chest, also referred to as a water tank or water holding tank, providing a supply of water to a toilet bowl. The automatic flush toilet and automatic flush assembly of the present invention are of particular use in private residences where bowl-type toilets are typically found. The automatic flush assembly of the present invention may be used to retrofit existing bowl-type toilets by the methods disclosed herein. This will convert the existing bowl-type toilet into an automatic flush toilet in accordance with the present invention.

As is well-known in the art, conventional bowl-type toilets include a toilet bowl and a water chest, or water holding tank, located immediately rearward of the toilet bowl. The water holding tank and the toilet bowl are in fluid communication through a ball cock, flapper valve, or other similar type of flush valve that is opened by an actuating handle linked to the flush valve. Typically, the actuating handle is linked to the flush valve by a lever and chain. Preferably, the automatic flush assembly of the present invention is mounted in a handle opening in the water holding tank once the actuating handle is removed.

The toilet having the automatic flush assembly in accordance with the present invention generally includes a toilet bowl, a water holding tank (hereinafter "holding tank") for supplying water to the toilet bowl, a flush valve providing fluid communication between the toilet bowl and the water holding tank, and the automatic flush assembly. The water holding tank defines a handle opening adapted to accept an actuating handle of the toilet. The handle opening may be in the front wall of the water holding tank or in one of the sidewalls of the water holding tank, and the automatic flush assembly of the present invention is adapted for use in either location. The automatic flush assembly is mounted in the handle opening. As is conventional in the art, the flush valve is adapted to flush the toilet bowl with water from the water holding tank upon activation.

The automatic flush assembly generally includes a sensor section positioned to detect the presence of a person in an area in front of the toilet bowl, a control section operatively connected to the sensor section, and an actuating mechanism for actuating the flush valve. The control section is connected to the sensor section for receiving a detection signal from the sensor section indicating the presence of a person in the area in front of the toilet bowl. The actuating mechanism is adapted to actuate the flush valve in response to a flush signal from the control section.

The actuating mechanism may be connected to the flush valve by a lever arm and chain, for example, the lever arm and chain that is pre-existing in the water holding tank. The actuating mechanism may be a rotary solenoid operatively connected to the lever arm for rotating the lever arm, thereby placing the chain in tension and actuating the flush valve. Alternatively, the actuating mechanism may also be a motor-driving gearing adapted to rotate the lever arm, thereby placing the chain in tension and actuating the flush valve.

The sensor section may be a radiation beam emitter for directing a radiation beam in the area in front of the toilet bowl and a radiation beam receiver for receiving a reflected radiation beam from a person located in the area in front of the toilet bowl. The control section may be a control circuit or device which receives the detection signal from the radiation beam receiver until the detected person exits the area in front of the toilet bowl, whereupon the control circuit or device initiates the flush signal to the actuating mechanism. The control circuit or device may be adapted to initiate the flush signal to the actuating mechanism after a preset period of time has elapsed after the detection signal is terminated. The radiation beam transmitter and radiation beam receiver may be adapted to generate and receive infrared beams.

The automatic flush assembly may further include a housing supporting the sensor section, control section, and actuating mechanism. The housing may be divided into sections, including a head portion located external to the water holding tank and a body portion located substantially internal to the water holding tank and supporting at least the actuating mechanism. The body portion of the housing may define a compartment for one or more disposable or rechargeable batteries used to provide electrical power to the automatic flush assembly. Thus, the automatic flush assembly may be battery-powered. Additionally, the head portion may be connected to the body portion so that the head portion articulates relative to the body portion. Further, the head portion may be joined to the body portion by a threaded connection therewith. The connection between the head portion and the body portion is preferably situated in the handle opening in the water holding tank.

As indicated, the automatic flush assembly may be retrofitted into the handle opening of a bowl-type toilet actuated by a flush valve. The retrofit automatic flush assembly of the present invention may generally include a sensor section for detecting the presence of a person in an area in front of the toilet, an actuating mechanism for actuating the flush valve of the toilet, and a control section operatively connected to the sensor section and actuating mechanism. The control section receives a detection signal from the sensor for indicating the presence of a person in the area in front of the toilet bowl. The actuating mechanism may be adapted for connection to the flush valve to actuate a flush valve in response to a flush signal from the control section.

The actuating mechanism may be adapted for connection to an existing lever arm and chain of the toilet that is used to actuate the flush valve. The actuating mechanism may be a motor. The motor may drive gearing adapted for a connection to the lever arm for rotating the lever arm, thereby placing the chain in tension and actuating the flush valve. The actuating mechanism may also be a rotary solenoid adapted for connection to the lever arm for rotating the lever arm, thereby placing the chain in tension and actuating the flush valve.

The sensor section may include a radiation beam emitter for emitting a radiation beam and a radiation beam receiver for receiving a reflected radiation beam. The control section may include a control circuit or device for receiving the detection signal from the radiation beam receiver and initiating the flush signal to the actuating mechanism upon termination of the detection signal. The control circuit or device may initiate the flush signal to the actuating mechanism after a preset period of time has elapsed after the detection signal is terminated. The radiation beam transmitter and radiation beam receiver may be adapted to generate and receive infrared radiation beams.

The automatic flush assembly may have a housing supporting the sensor section, control section, and actuating mechanism. The housing may include a head portion to be located external to a water holding tank of the toilet and a body portion to be located substantially internal to the water holding tank and supporting at least the actuating mechanism. The body portion of the housing may define a compartment for one or more disposable or rechargeable batteries used to provide electrical power to the sensor section, control section, and actuating mechanism. Thus, the elements of the automatic flush assembly may be battery-powered. Additionally, the head portion may be connected to the body portion so that the head portion articulates relative to the body portion. Further, the head portion may be joined to the body portion by a threaded connection therewith.

The automatic flush assembly may be retrofitted into the actuating handle opening in a conventional bowl-type toilet having a flush valve. Typically, the handle opening for the actuating handle is defined in the front wall of a water holding tank of such bowl-type toilets, but may also be located in one of the sidewalls of the water holding tank. The method generally includes removing the actuating handle provided in the front or side of the bowl-type toilet and replacing the actuating handle with the automatic flush assembly of the present invention. The actuating mechanism may then be connected to the flush valve using the existing lever arm and chain of the toilet, or a new lever arm and chain may be provided.

The automatic flush assembly may include a housing supporting the sensor section, control section, and actuating mechanism. The housing may include separate parts or portions, including a head portion and a body portion supporting at least the actuating mechanism. The method may further include positioning the head portion externally on the water holding tank of the toilet and the body portion substantially internally in the water holding tank and joining the head portion to the body portion in the handle opening, for example by a threaded connection therebetween. The head and body portions may be linked or connected such that the head portion articulates relative to the body portion.

The actuating mechanism may be a motor-driving gearing and the method may further include linking the gearing to the flush valve, such that activation of the motor actuates the flush valve. Alternatively, the actuating mechanism may be a rotary solenoid, and the method may include linking the rotary solenoid to the flush valve, such that activation of the rotary solenoid actuates the flush valve.

In accordance with the foregoing method, a conventional bowl-type toilet may simply and easily be converted into an automatic flush toilet at relatively low cost and without the necessity of purchasing a new toilet with an automatic toilet flushing system. In operation, when a person, animal, or object approaches the automatic flush toilet, the person, animal, or object will interrupt and reflect the radiation beam emitted from the radiation beam emitter. The return radiation beam is received by the radiation beam receiver, which initiates the detection signal to the control section of the automatic flush assembly. After the control section receives the detection signal, for example, for a preset period of time, the control section will initiate a flush signal to the actuating mechanism.

Once the flush signal is initiated to the actuating mechanism, the actuating mechanism may rotate, pivot, or lift the lever arm of the toilet, which places the chain in tension, raising or opening the flush valve of the toilet and allowing water from the water holding tank to flush the toilet bowl. In particular, if the actuating mechanism is a rotary solenoid, rotation of the solenoid output shaft will cause the lever arm to rotate or lift upward, thereby placing the chain in tension and actuating the flush valve. Alternatively, as indicated, the actuating mechanism may be a motor, such as a small DC motor having an output shaft. The motor may be operatively connected by gearing to the lever arm. The gearing may include one or more gears and the existing or new lever arm may be mounted on one of the gear shafts. The flush signal causes the motor to engage, thereby rotating the output shaft and rotating or lifting the lever arm to actuate the flush valve.

Further details and advantages of the present invention will become apparent from the following detailed description when read in conjunction with the drawings.

DETAILED DESCRIPTION OF THE INVENTION

Figure 1:
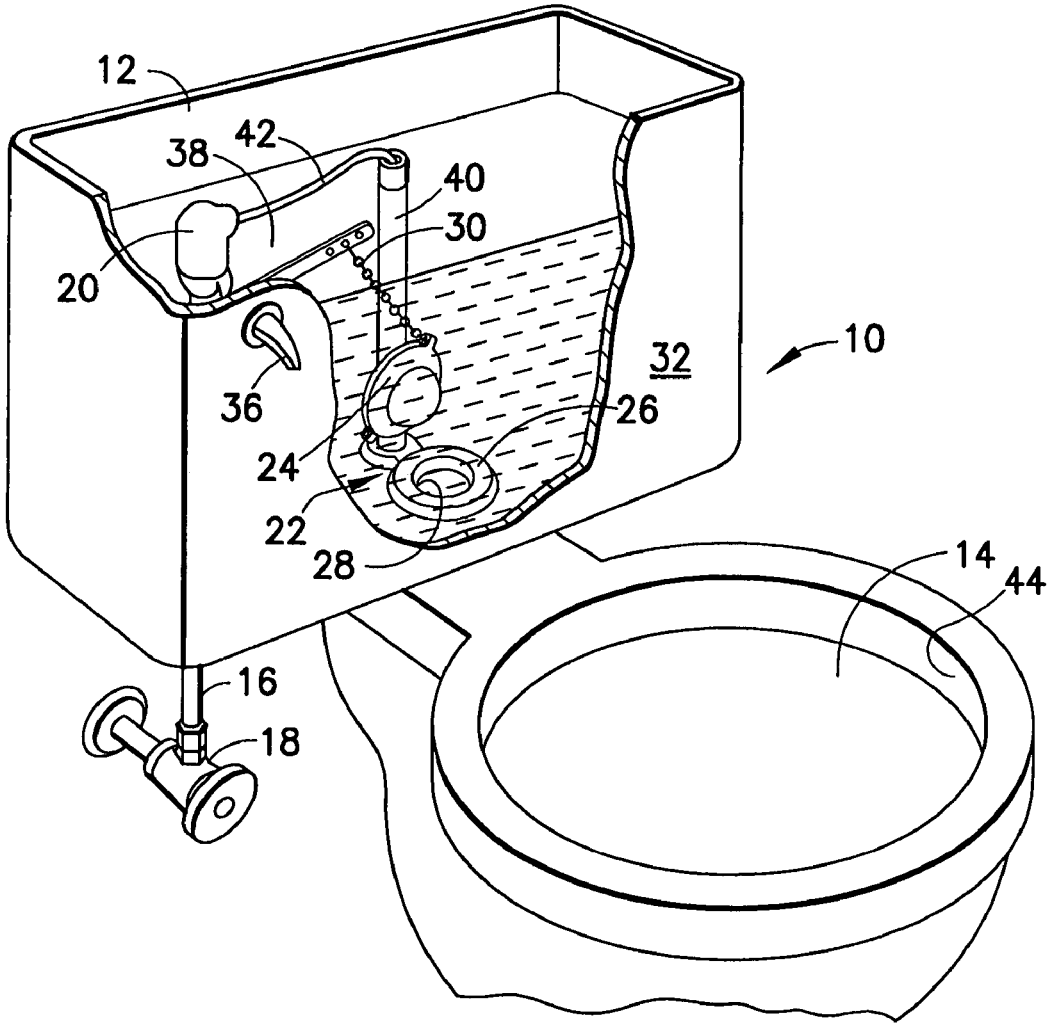
FIG. 1 PRIOR ART
FIG. 1 is a perspective and partially cutaway view of a conventional bowl-type toilet that may be retrofitted to provide an automatic flush toilet in accordance with the present invention.

For purposes of the description hereinafter, the terms "upper", "lower", "right", "left", "vertical", "horizontal", "top", "bottom", and derivatives thereof, shall relate to the invention as it is oriented in the drawing figures. However, it is to be understood that the invention may assume various alternative variations and step sequences except where expressly specified to the contrary. It is also to be understood that the specific devices and processes illustrated in the attached drawings and described in the following text are simply exemplary embodiments of the invention. Hence, specific dimensions and other physical characteristics related to the embodiments disclosed hereinafter are not to be considered limiting.

Referring to FIG. 1, a conventional bowl-type toilet 10 that may be retrofitted to an automatic flush toilet in accordance with the present invention is shown. The toilet 10 includes a water holding tank 12 (hereinafter "holding tank 12") connected to a toilet bowl 14. The holding tank 12 provides a supply of water to flush the toilet bowl 14. The holding tank 12 is supplied with water through a water pipe 16, which is connected to the holding tank 12 through a water inlet valve 18.

The water pipe 16 is connected to a fill valve 20 which is operated by the level of the water in the holding tank 12. A flush valve 22 provides fluid communication between the holding tank 12 and toilet bowl 14. The flush valve 22 maintains the water level in the holding tank 12 when it is closed and lets water into the toilet bowl 14 when it is open (i.e., actuated). The flush valve 22 may be a ball cock, flapper valve, or other similar conventional valve commonly used in bowl-type toilets. The flush valve 22 is illustrated in the Figures as a flapper valve and comprises a flapper lid 24 and seat 26. The flush valve 22 is provided in a bowl opening 28 in the holding tank 12. The bowl opening 28 enables fluid communication between the holding tank 12 and toilet bowl 14 when the flush valve 22 is in the open or actuated state. The flapper lid 24 is lifted from the seat 26 to open or actuate the flush valve 22.

Preferably, a chain 30 is connected to the flapper lid 24 and is used to open or actuate the flush valve 22 by lifting the flapper lid 24 from the seat 26, as is conventional in the art. In operation, once the flapper lid 24 is lifted from the seat 26, the flush valve 22 is open allowing water to flow from the holding tank 12 into the toilet bowl 14 through the bowl opening 28. Once the water level drops below the flapper lid 24, the flapper lid 24 closes under the force of gravity and seats against the seat 26, closing the bowl opening 28 and preventing further water flow from the holding tank 12 to the toilet bowl 14.

The holding tank 12 has a front wall 32 which defines a handle opening 34, and opposing sidewalls 35. An actuating handle 36 is provided in the handle opening 34 in the front wall 32 of the holding tank 12. The actuating handle 36 is mounted pivotally in the handle opening 34. A lever arm 38 is connected to the actuating handle 36. The lever arm 38 is located within the holding tank 12 and is connected to the chain 30 for actuating the flush valve 22. In particular, the lever arm 38 is connected to the actuating handle 36 so by pivoting or rotating the actuating handle 36, the lever arm 38 lifts the chain 30, thereby placing the chain 30 in tension which then lifts the flapper lid 24 and actuates the flush valve 22.

An overflow stand pipe 40 is connected to the fill valve 20 by a tube 42 which supplies water to the stand pipe 40 whenever the fill valve 20 is opened by a drop in the water level in the holding tank 12. The stand pipe 40 is connected to the toilet bowl 14 so as to empty water to the toilet bowl 14 if the fill valve 20 malfunctions, for example by sticking open, and is also arranged to supply water to the inside of a rim 44 of the toilet bowl 14 to rinse the rim 44 during flushing and refilling (e.g., a flush cycle). The components of the toilet 10 discussed hereinabove are conventional and well-known in the art and are disclosed, for example, by U.S. Pat. No. 5,228,146 to Martell, the disclosure of which is incorporated herein by reference.

Referring to FIGS. 2-6, an automatic flush assembly 50 (hereinafter "flush assembly 50") is mounted to the toilet 10 and is adapted to actuate the flush valve 22 to flush the toilet bowl 14 with water from the holding tank 12, thereby making the toilet 10 an automatic flush toilet in accordance with the present invention. More particularly, the flush assembly 50 is mounted in the handle opening 34 formed in the front wall 32 of the holding tank 12 and is linked, preferably by mechanical structures, to the flush valve 22 to actuate the flush valve 22. For example, the existing lever arm 38 and chain 30 of the toilet 10 may be connected to the flush assembly 50, as illustrated in FIGS. 2-6. Alternatively, a new lever arm and chain or other similar mechanical linkage may be substituted in place of the lever arm 38 and chain 30 to link the flush assembly 50 to the flush valve 22 for actuating the flush valve 22. The flush assembly 50 will be described herein with reference to the existing lever arm 38 and chain 30, however, it will be appreciated that the present invention is not intended to be limited to this specific structure, as indicated previously. In operation, the flush assembly 50 is adapted to rotate or pivot the lever arm 38, thereby placing the chain 30 in tension and actuating the flush valve 22 by lifting the flapper lid 24 from the seat 26.

Figure 4:
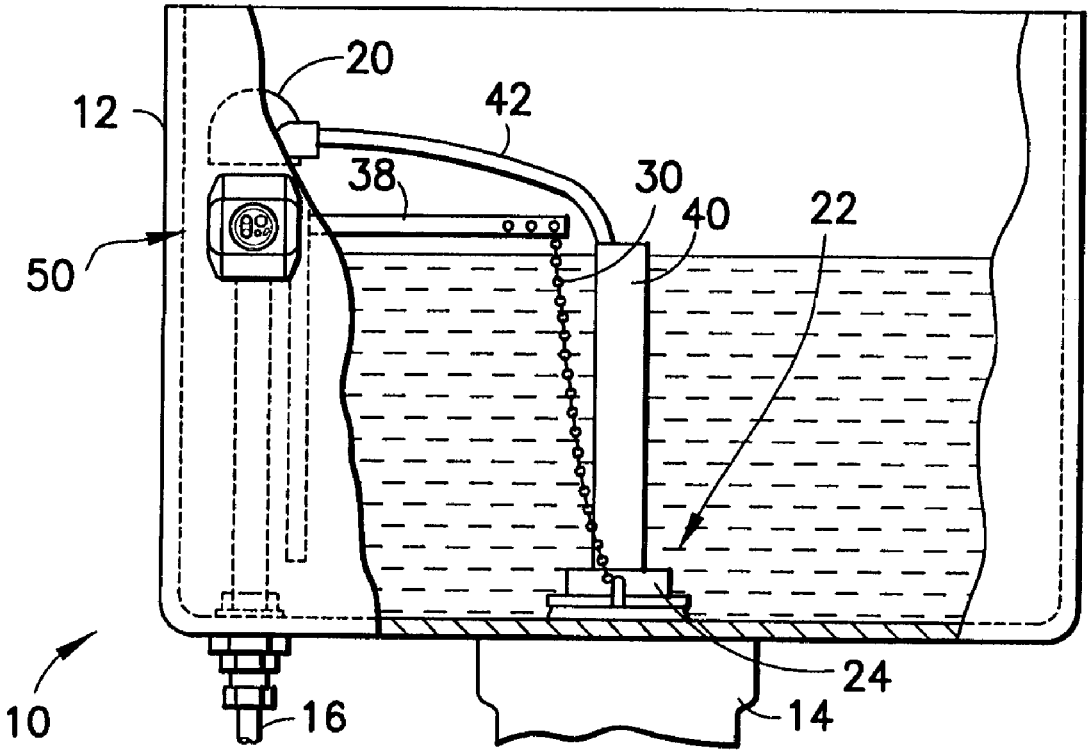
FIG. 4 is a partial cross-sectional and cutaway view of the water holding tank of the automatic flush toilet shown in FIG. 2, showing the flush valve of the automatic flush toilet before actuation.
Figure 5A:
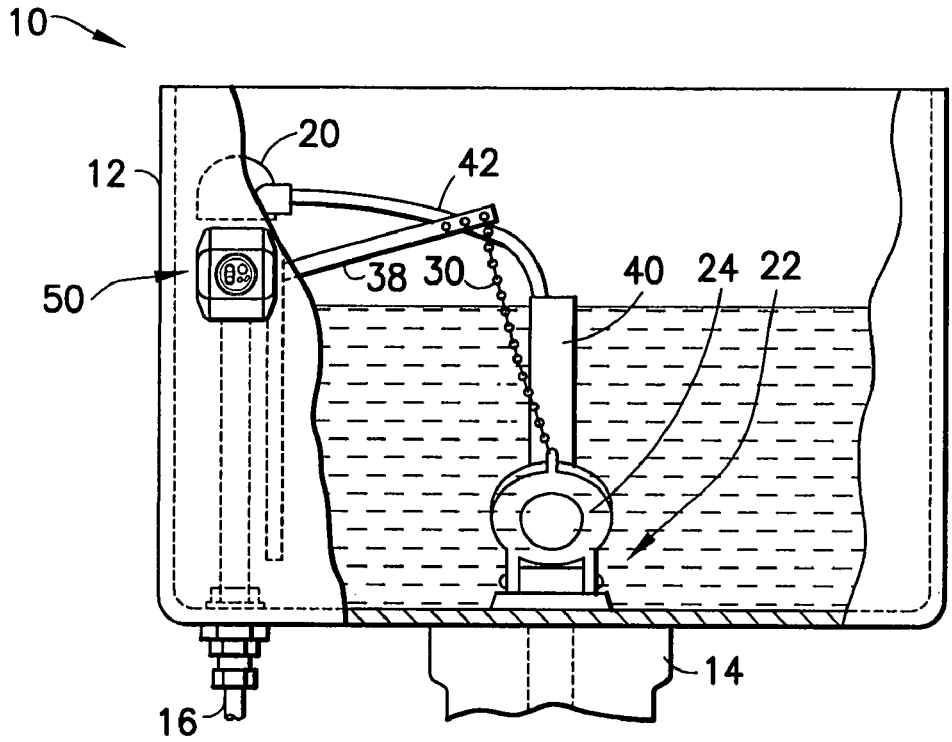
FIG. 5A is a partial cross-sectional and cutaway view of the water holding tank of the automatic flush toilet shown in FIG. 2, showing the flush valve just after actuation.
Figure 5B:
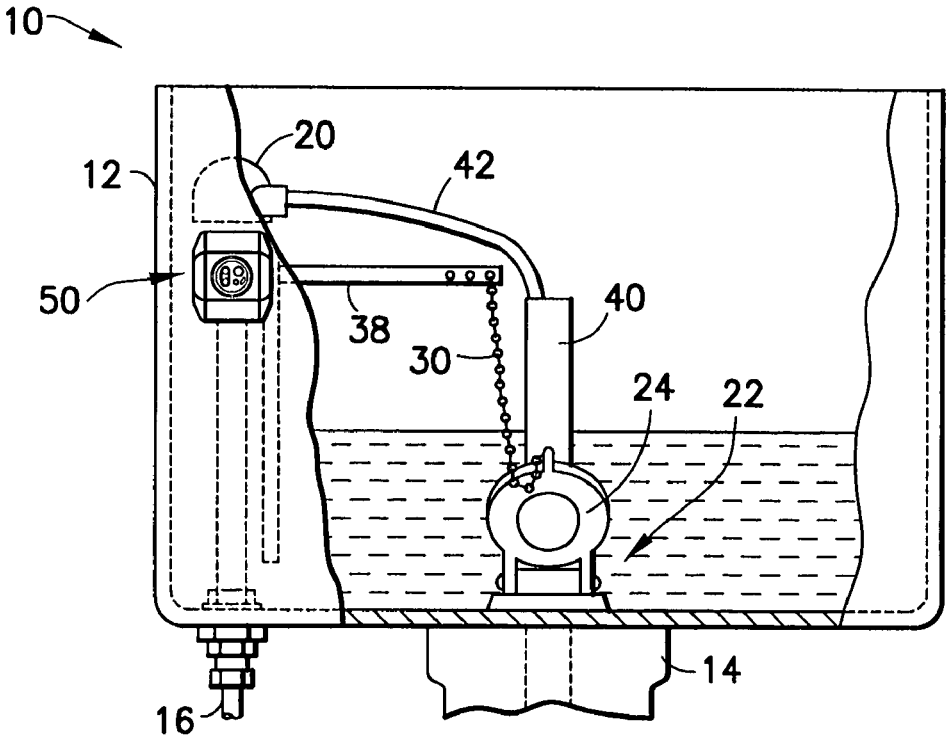
FIG. 5B is a partial cross-sectional and cutaway view of the water holding tank of the automatic flush toilet shown in FIG. 2, showing the flush valve after actuation and the water in the water holding tank draining into the toilet bowl.
Figure 6:
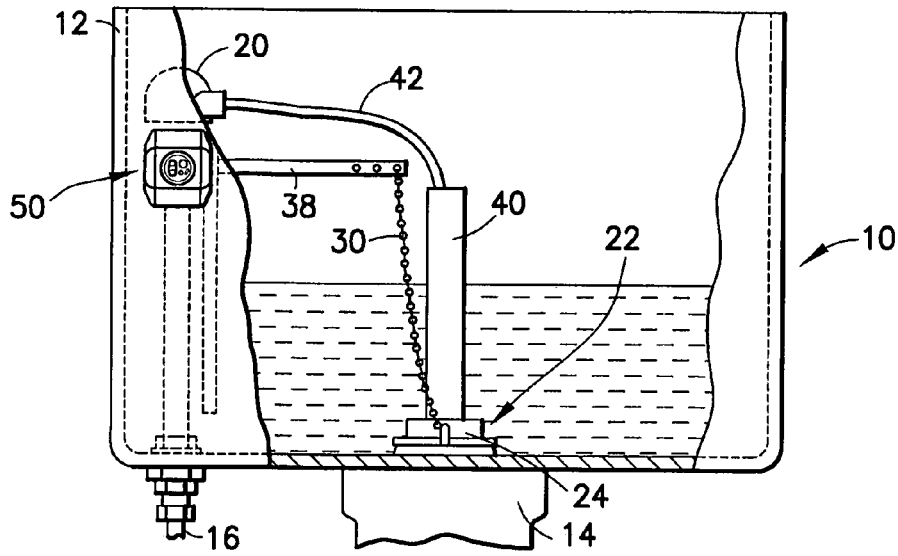
FIG. 6 is a partial cross-sectional and cutaway view of the water holding tank of the automatic flush toilet shown in FIG. 2, showing the water holding tank refilling with water after the toilet bowl has been flushed with water.

In general, the flush assembly 50 is adapted to sense or detect the presence of a person, animal, or object in an area 52 in front of the toilet bowl 14. The flush assembly 50 is preferably configured to differentiate between an actual user of the toilet 10 and a person, animal, or object that happens to stray into the area 52 in front of the toilet bowl 14. In response to the detection of a toilet user in the area 52 in front of the toilet bowl 14, the flush assembly 50 actuates the flush valve 22, upon the departure of the toilet user from the area 52 in front of the toilet bowl 14. FIG. 4 illustrates the flush valve 22 just before being actuated by the flush assembly 50 via the lever arm 38 and chain 30, and FIG. 5 shows the flush valve 22 at the time of actuation (FIG. 5A) and a time after actuation (FIG. 5B) by the flush assembly 50, via the lever arm 38 and chain 30. Upon activation by the flush assembly 50, the flush valve 22 allows water to flow from the holding tank 12 into the toilet bowl 14. When the water level in the holding tank 12 drops below the flapper lid 24, the flapper lid 24 closes against the seat 26 and the holding tank 12 refills with water entering through the water pipe 16 and water inlet valve 18 in a conventional manner. FIG. 6 illustrates the re-filling of the holding tank 12, once the flapper lid 24 seats against the seat 26 and closes the bowl opening 28, thereby completing the flush cycle. The flush assembly 50 automates the foregoing flush cycle of the toilet 10.

Referring to FIGS. 2-8, the flush assembly 50 generally includes a sensor section 54, a control section 56, and an actuating mechanism 58 that is adapted to actuate the flush valve 22. The components of the flush assembly 50 are preferably contained within a housing 60. The housing 60 may be made of plastic material or another suitable material such as metal, for example steel or aluminum. The housing 60 may be a unitary body, generally comprised of a first or head portion 62 that contains the sensor section 54 and control section 56, and a second or body portion 64 that extends from the first or head portion 62 and contains the actuating mechanism 58. The body portion 64 may be sized to extend through the handle opening 34 in the holding tank 12. Thus, to install the flush assembly 50, the body portion 64 may simply be inserted into the handle opening 34 and secured therein. The body portion 64 of the housing 60 may be secured in the handle opening 34 by any suitable methods known in the art, including by adhesive, mechanical methods, and the like, desirably, with a water tight seal, such as with a rubber washer.

Figure 8:
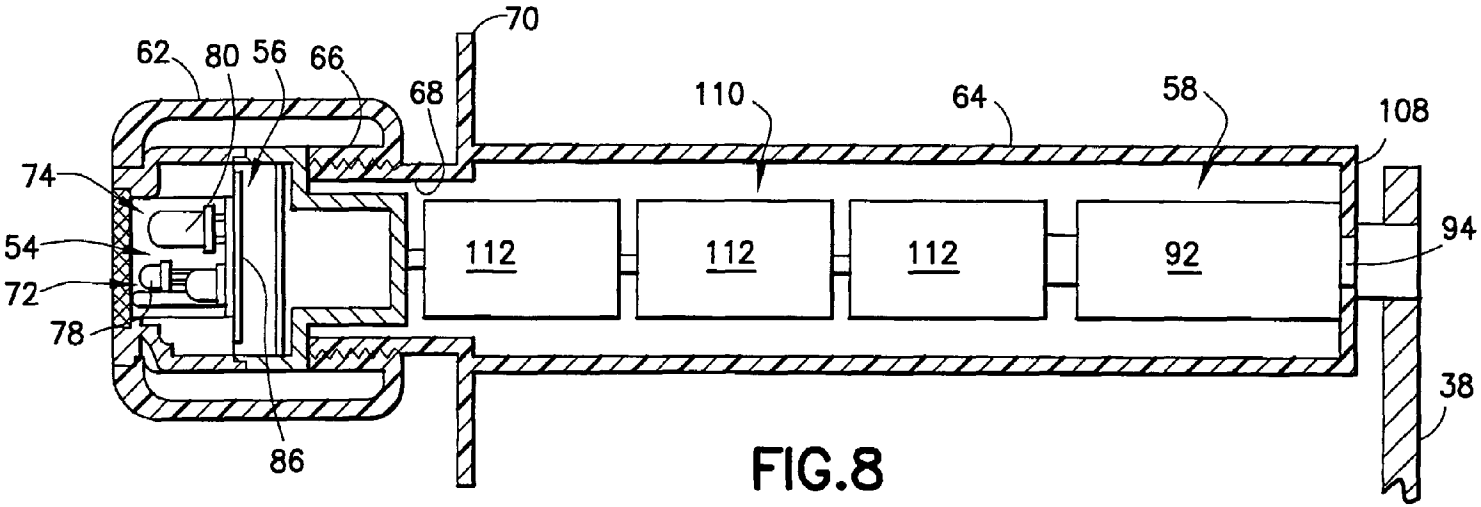
FIG. 8 is a longitudinal cross-sectional view taken along line 8-8 in FIG. 7.

More preferably, the head and body portions 62, 64 of the housing 60 are formed separately and joined together in the handle opening 34 to secure the flush assembly 50 in the handle opening 34. For example, as shown in FIG. 8 and, additionally FIG. 10, discussed herein, the head portion 62 is formed as a separate body from the body portion 64, so that these and configured components may be connected together in the handle opening 34. The separable construction of the housing 60 facilitates easy installation of the flush assembly 50 in the toilet 10 and further, the replacement of batteries used to provide electrical power to the components of the flush assembly 50 as discussed herein.

Figure 2:
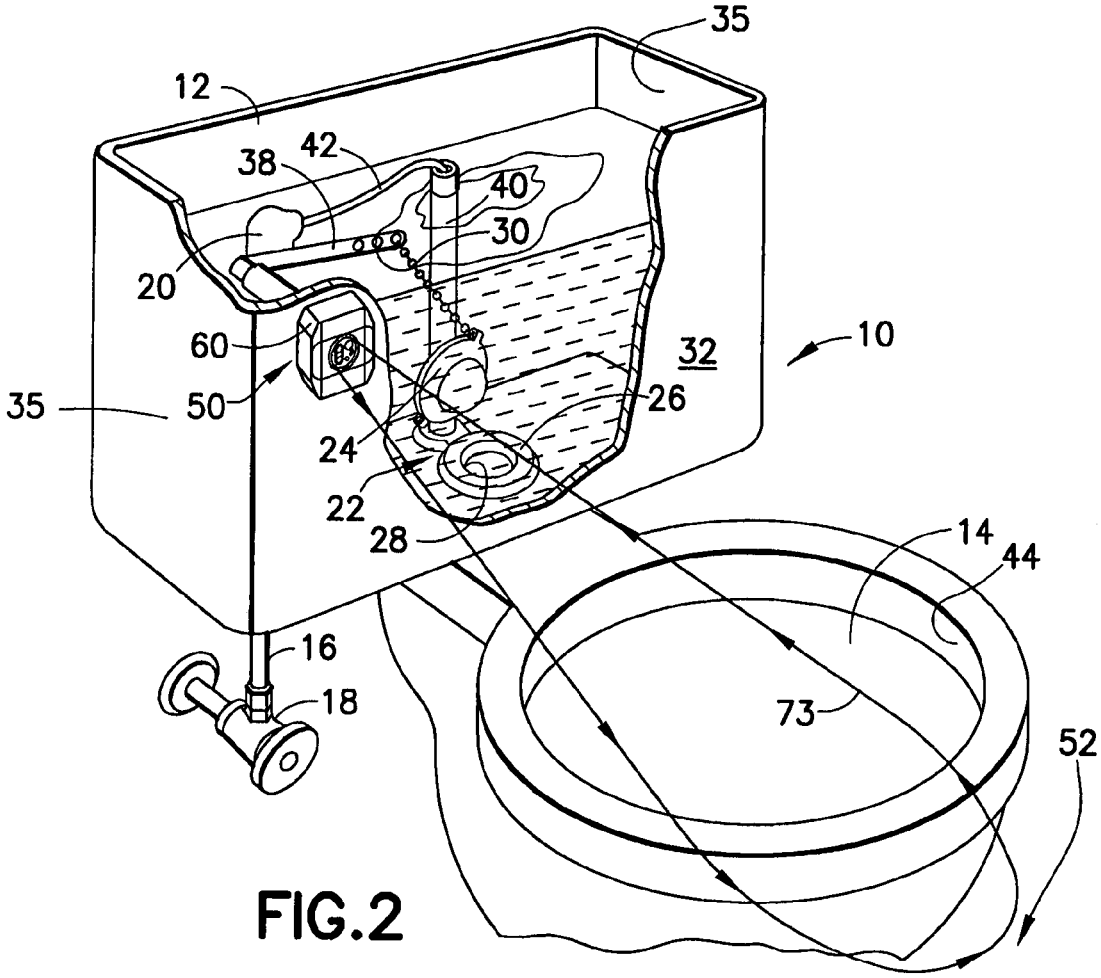
FIG. 2 is a perspective and partially cutaway view of an automatic flush toilet having an automatic flush assembly in accordance with the present invention.
Figure 3:
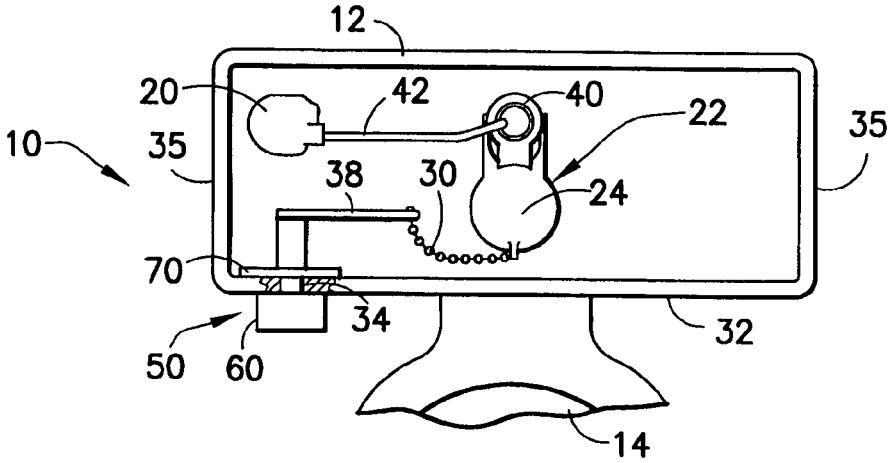
FIG. 3 is a plan view of a water holding tank of the automatic flush toilet shown in FIG. 2.

In this arrangement, the head portion 62 has an internally threaded portion 66 adapted to receive an externally threaded portion 68 of the body portion 64. The head portion 62 and body portion 64 are configured such that the internally threaded portion 66 and externally threaded portion 68 engage within the handle opening 34 in the holding tank 12, as shown, for example, in FIG. 2. For this purpose, the body portion 64 has a circumferential flange 70 adapted to contact the internal side of the front wall 32 of the holding tank 12 when the internally threaded portion 66 of the head portion 62 and the externally threaded portion 68 of the body portion 64 are engaged. In particular, when the internally threaded portion 66 is threadably engaged with the externally threaded portion 68, the flange 70 abuts against the internal side of the front wall 32 of the holding tank 12, allowing the head portion 62 and body portion 64 to be drawn together in the handle opening 34. The separable form of the housing 60 allows for the quick installation of the flush assembly 50 and further, easy replacement of batteries as discussed further herein. As depicted in FIGS. 2 and 8, the externally threaded portion 68 of the body portion 64 is sized to be received in the handle opening 34, and the mating threads between the head portion 62 and body portion 64 are configured such that when these components are threaded together, the head portion 62 is oriented in the configuration shown in FIG. 2 (i.e., upright).

Referring to FIGS. 2-8 and 11, the sensor section 54 serves to detect the presence of a person, animal, or object that enters the area 52 in front of the toilet bowl 14. In particular, the sensor section 54 is adapted to detect a person that has entered the area 52 in front of the toilet bowl 14 and who intends to use the toilet 10 from either a standing or sitting position. In the Figures of the disclosure, electrical power supply lines for delivering power to the respective elements of the flush assembly 50 are omitted for clarity.

The sensor section 54 generally includes a radiation beam emitter 72 for transmitting a radiation beam 73 to the area 52 in front of the toilet bowl 14, and a radiation beam receiver 74 adapted to receive a reflected radiation beam that reflects from the user of the toilet 10. Preferably, the radiation beam emitter 72 and radiation beam receiver 74 are adapted to emit and receive infrared radiation beams. The components of the radiation beam emitter 72 include a driver 76 and an infrared light emitting diode (LED) 78. The radiation beam receiver 74 generally includes a phototransistor 80, an amplifier 82, and a comparator 84.

The sensor section 54 is operatively connected to the control section 56 for providing a detection signal to the control section 54 indicative of the presence of a person in the area 52 in front of the toilet bowl 14. In particular, the radiation beam receiver 74 is operatively connected to the control section 56 via the phototransistor 80, amplifier 82, and comparator 84, and provides the detection signal to the control section 56.

The control section 56 includes a control circuit or device 86, such as a microprocessor (i.e., CPU), which receives the detection signal from the sensor section 54 and a driver 88 adapted to output a flush signal to the actuating mechanism 58. The sensor section 54 and control section 56 may be conventional optical or acoustical sensing and control devices known in the field of automatic toilet flushing systems. A suitable infrared sensing and control device known in the art is disclosed by U.S. Pat. No. 5,482,250 to Kodaira, incorporated herein by reference. Other suitable infrared sensing and control devices that may be used for the sensor section 54 and control section 56 are disclosed by U.S. Pat. No. 4,309,781 to Lissau; U.S. Pat. No. 5,169,118 to Whiteside; and U.S. Pat. No. 6,161,814 to Jahrling, all assigned to the Sloan Valve Company, the disclosures of which are incorporated herein by reference.

The sensor section 54 and control section 56 generally operate as follows. The control circuit 86 initiates a control signal to the driver 76. In response, the driver 76 becomes operative and current is delivered to the infrared light emitting diode (LED) 78, from which the infrared radiation beam 73 is outputted to the area 52 in front of the toilet bowl 14. When the infrared radiation beam 73 is reflected by an intended user of the toilet 10, the reflected radiation beam 73 is received by the phototransistor 80. The phototransistor 80 provides an output signal to the amplifier 82, which amplifies the output signal and passes the output signal to the comparator 84. The comparator 84 compares the amplified output signal with a reference value. When the amplified output signal is above a preset reference value, the comparator 84 initiates a detection signal and outputs the detection signal to the control circuit 86 (i.e., CPU). If the person, animal, or object does not remain in the area 52 of the toilet bowl 14 for a sufficient time, the output signal will not exceed the preset reference value in the comparator 84 and no detection signal will be outputted to the control circuit 86.

When the user enters the area 52 in front of the toilet bowl 14 or sits on the toilet bowl 14 for more than a preset or predetermined time, for example 2 to 5 seconds, the detection signal is continuously inputted to the control circuit or device 86 during that time period. Thereafter, when the user exits the area 52 in front of the toilet bowl 14 or stands up and moves away from the toilet bowl 14, the radiation beam 73 is re-established in the area 52 in front of the toilet bowl 14 and the detection signal is no longer outputted to the control circuit 86. Once the detection signal is discontinued, the control circuit 86 initiates a flush signal to the driver 88 and current is delivered to the actuating mechanism 58, which then actuates the flush valve 22 by rotating or pivoting the lever arm 38 upward (i.e., counterclockwise) thereby placing the chain 30 in tension. The control circuit 86 then discontinues the flush signal, which de-energizes the actuating mechanism 58, and returns the lever arm 38 to a neutral (i.e., level) position, as shown in FIG. 5B.

Preferably, the control circuit or device 86 includes a time delay feature such that the flush signal is initiated to the driver 88 only after a preset or predetermined period of time, for example 2 to 5 seconds, has elapsed after the detection signal has been discontinued, allowing the user of the toilet 10 to exit the area 52 in front of the toilet bowl 14 before the toilet 10 flushes. The control section 56 may further include a manual override button 90 directly connected to the driver 88 to permit the user to initiate the flush signal directly to the driver 88, which energizes the actuating mechanism 58 to flush the toilet 10 in the event of a malfunction with the sensor section 54 or control section 56.

Figure 7:
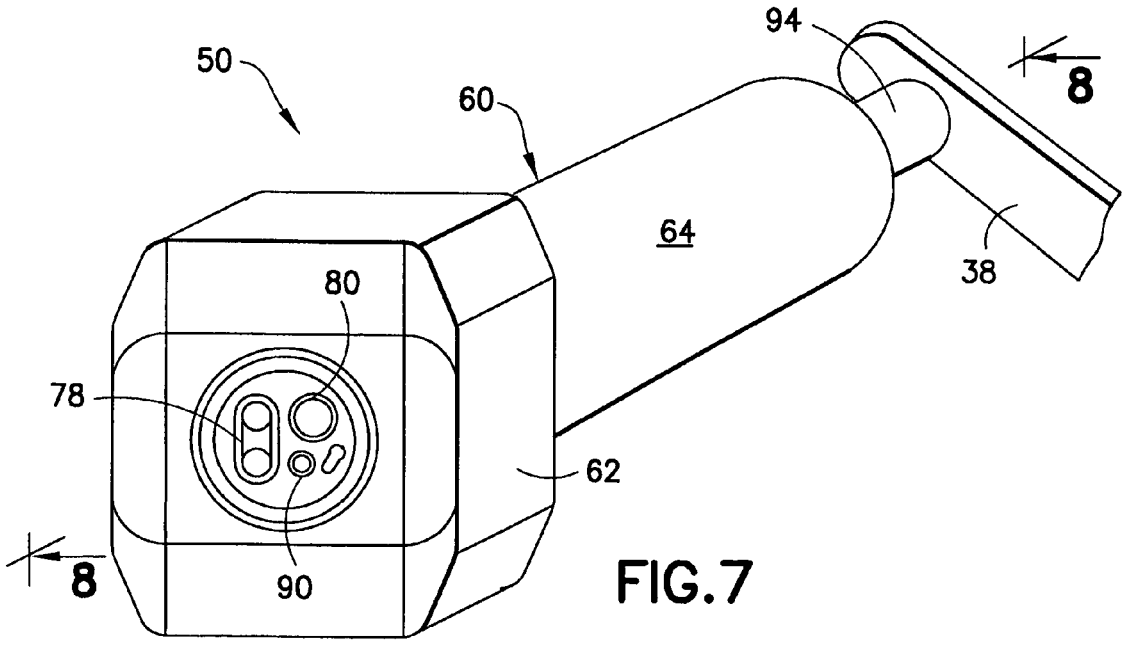
FIG. 7 is a perspective view of an automatic flush assembly in accordance with a first embodiment of the present invention.

FIGS. 7 and 8 show the flush assembly 50 in accordance with a first embodiment of the present invention. In FIGS. 7 and 8, the control section 56 is operatively connected to the actuating mechanism 58 for controlling and actuating the actuating mechanism 58 in the manner discussed previously. The actuating mechanism 58, according to the first embodiment, includes a rotary solenoid 92 having an output shaft 94. The lever arm 38 is preferably mounted on the output shaft 94. After the control section 56 initiates the flush signal, the rotary solenoid 92 is activated in the manner discussed previously, which causes the output shaft 94 to rotate, for example, counterclockwise which lifts the lever arm 38, thereby placing the chain 30 in tension and actuating the flush valve 22. Once the flush signal is discontinued, the rotary solenoid 92 is de-energized, which returns the lever arm 38 to a neutral (i.e., level) position. The lever arm 38 is preferably fixedly secured to the output shaft 94 by any means customary in the art, for example, with mechanical fasteners. A suitable rotary solenoid for use as the rotary solenoid 92 is manufactured by Solenoid Shutter.

Figure 10:
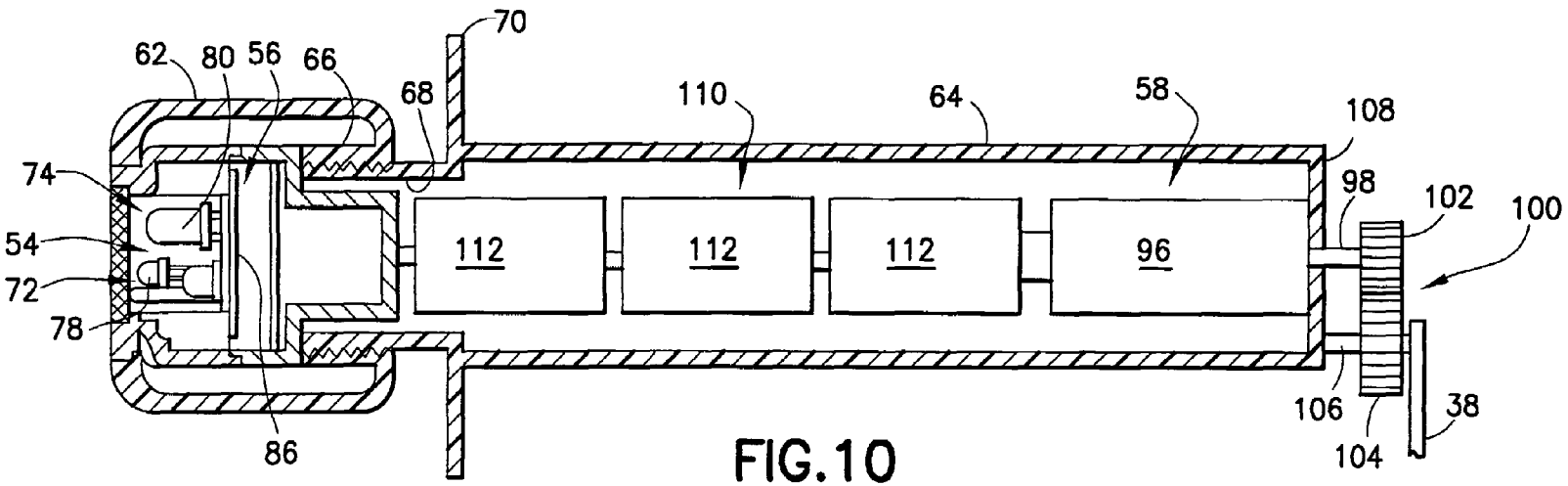
FIG. 10 is a longitudinal cross-sectional view taken along line 10-10 in FIG. 9.
Figure 9:
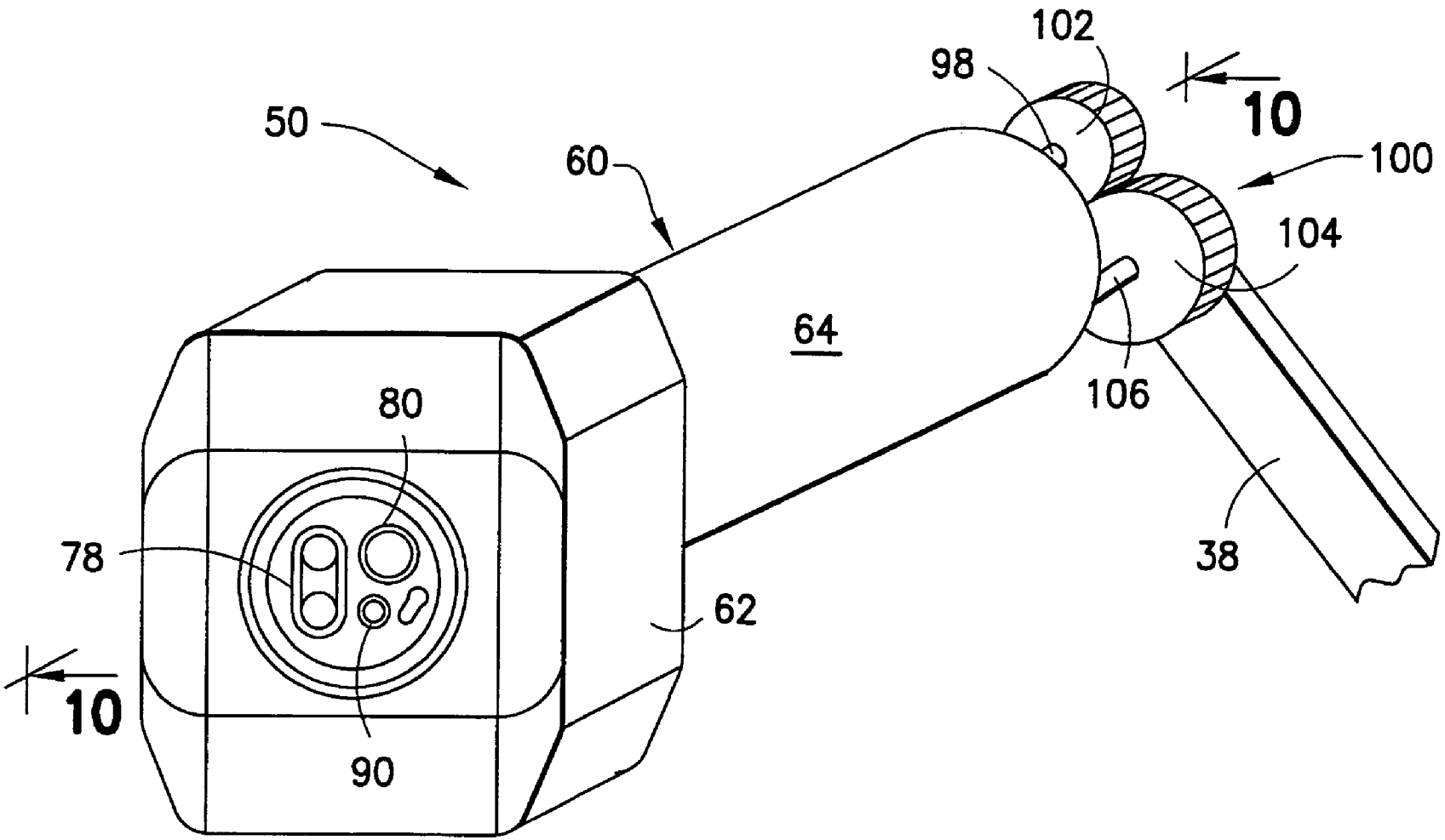
FIG. 9 is a perspective view of an alternative embodiment of the automatic flush assembly shown in FIG. 6.
Figure 11:
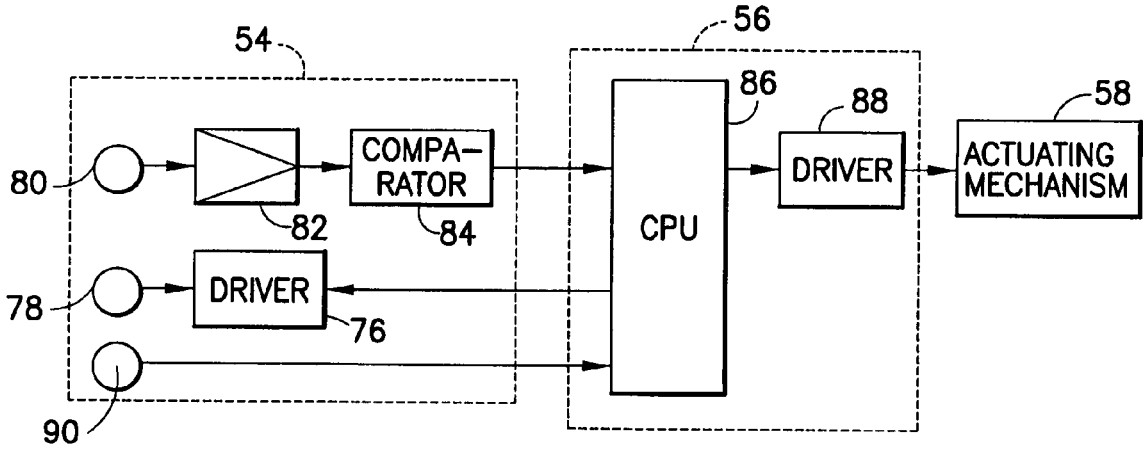
FIG. 11 is a block diagram showing the circuit configuration of the automatic flush assembly of FIGS. 7 and 9.

In an alternative embodiment of the flush assembly 50 shown in FIGS. 9 and 10, the actuating mechanism 58 includes a small DC motor 96 having an output shaft 98 in place of the rotary solenoid 92. The motor 96 is controlled and activated by the control section 56 in a similar manner to the rotary solenoid 92 discussed previously. The lever arm 38 may be mounted on the output shaft 98 in an analogous way in which the lever arm 38 is depicted in FIGS. 7 and 8 discussed previously. However, if additional mechanical advantage is required, the output shaft 98 may drive appropriate gearing 100, which rotates or pivots the lever arm 38, thereby placing the chain 30 in tension and actuating the flush valve 22. In particular, as shown in FIGS. 9 and 10, the output shaft 98 may have a first gear 102 mounted thereon which drives a second gear 104 mounted on a second shaft 106. The second shaft 106 may be mounted to the housing 60, and extend from an end 108 of the body portion 64 of the housing 60. The lever arm 38 is fixedly mounted on the second shaft 106 to pivot or rotate when the second gear 104 is driven by the first gear 102 and output shaft 98. Preferably, the gearing 100 and lever arm 38 are appropriately configured to pivot or rotate the lever arm 38 counterclockwise. In operation, after the control section 56 initiates the flush signal, the motor 96 is activated, causing the output shaft 98 and first gear 102 to rotate clockwise, thereby causing the second gear 102 to rotate counterclockwise, which lifts the lever arm 38, thereby placing the chain 30 in tension and actuating the flush valve 22. Once the flush signal is discontinued, the motor 96 is de-energized, which causes the gearing 100 to return the lever arm 38 to a neutral (i.e., level) position.

The several embodiments of the actuating mechanism 58 discussed hereinabove are located within the body portion 64 of the housing 60. Additionally, a source of portable electrical power 110 is located in the body portion 64 of the housing 60. As shown in FIGS. 8 and 10, the power source 110 may be conventional disposable or rechargeable batteries 112. The power source 110 provides power to the various components of the sensor section 54, control section 56, and rotary solenoid 92 or motor 96 which may comprise the actuating mechanism 58 in accordance with the present invention. The use of batteries 112 allows the flush assembly 50 to operate on DC current. This eliminates the need to provide an external power source for the flush assembly 50. Thus, a power cord that would be plugged into a wall outlet is eliminated by the flush assembly 50, which improves the aesthetic appearance of the toilet 10. However, the present invention includes the use of an external power source for power to the components of the flush assembly 50, such as using a power cord that would be plugged into a wall outlet.

Referring to FIGS. 1-11, the flush assembly 50 is easily retrofitted into existing bowl-type toilets by removing the existing actuating handle 36 from the toilet 10 and securing the flush assembly 50 in the handle opening 34 in the holding tank 12. Once the flush assembly 50 is secured in place in the handle opening 34, the lever arm 38 is connected to the output shaft 94, 98 of the actuating mechanism 58, either the rotary solenoid 92 or the motor 96, or to the second shaft 106 mounting the second gear 104, as shown in FIGS. 9 and 10. While the disclosure herein indicates that the existing lever arm 38 may be secured to the actuating mechanism 58, the present invention further encompasses including an entirely new lever arm and chain with the flush assembly 50, such that the person installing the flush assembly 50 need only secure the flush assembly 50 in the handle opening 34 and attach the new chain to the flush valve 22 to make the retrofitted toilet 10 fully operational. If the existing lever arm 38 and chain 30 are used, the toilet 10 is made operational by reconnecting the chain 30 to the lever arm 38, if the chain 30 was disconnected while the lever arm 38 was being mounted to the actuating mechanism 58, and reconnecting the chain 30 to the flush valve 22. The actuating mechanism 58 may be linked to the flush valve 22 by any suitable mechanical linkage, and the present invention is not limited to the lever arm 38 and chain 30 mechanical linkage discussed in this disclosure.

Figure 12:
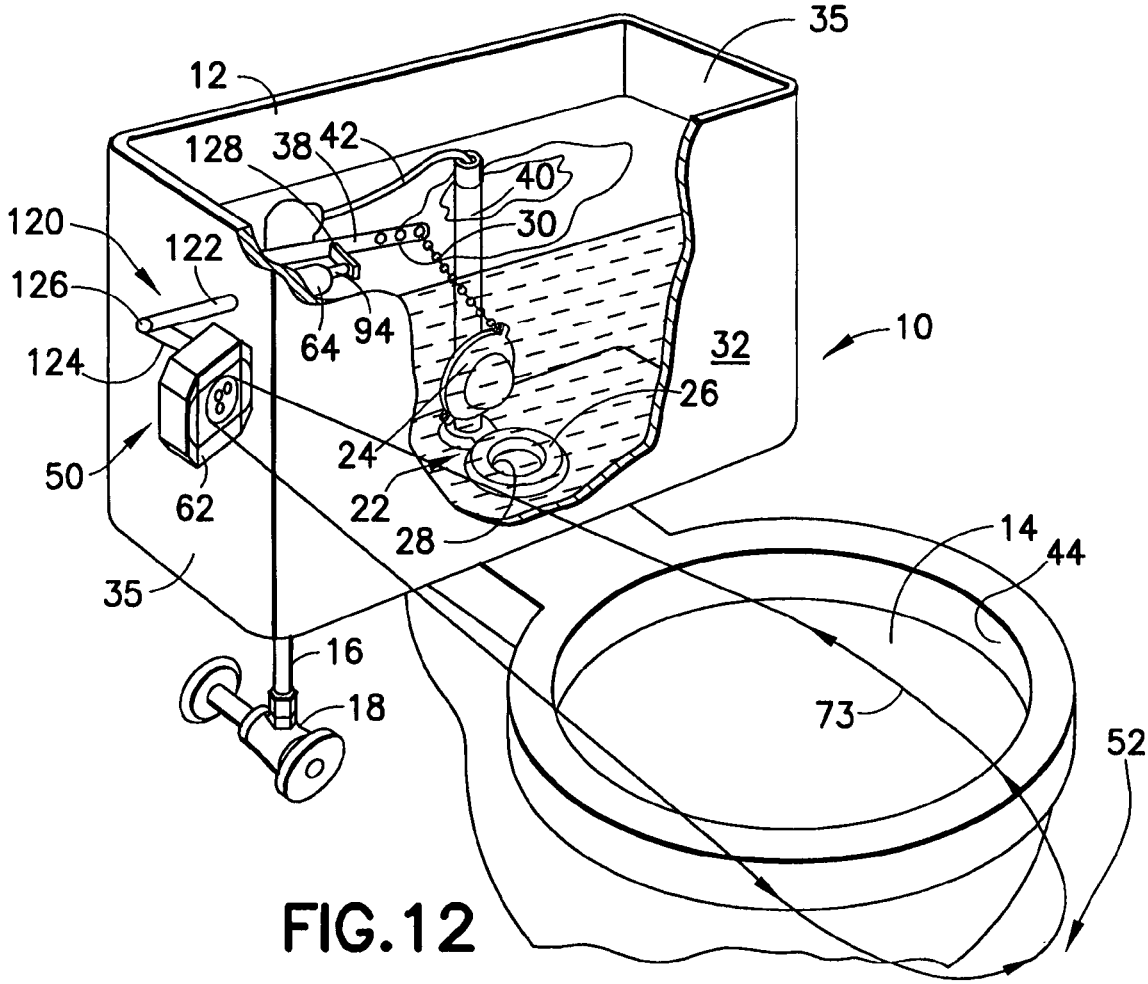
FIG. 12 is a perspective and partially cutaway view of the automatic flush toilet of the present invention incorporating a further embodiment of the automatic flush assembly.
Figure 13:
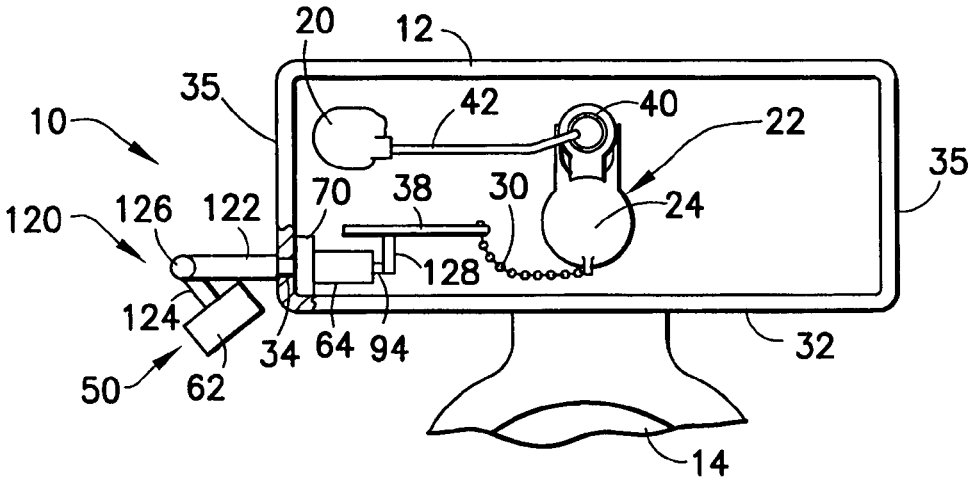
FIG. 13 is a plan view of a water holding tank of the automatic flush toilet shown in FIG. 12.
Figure 14:
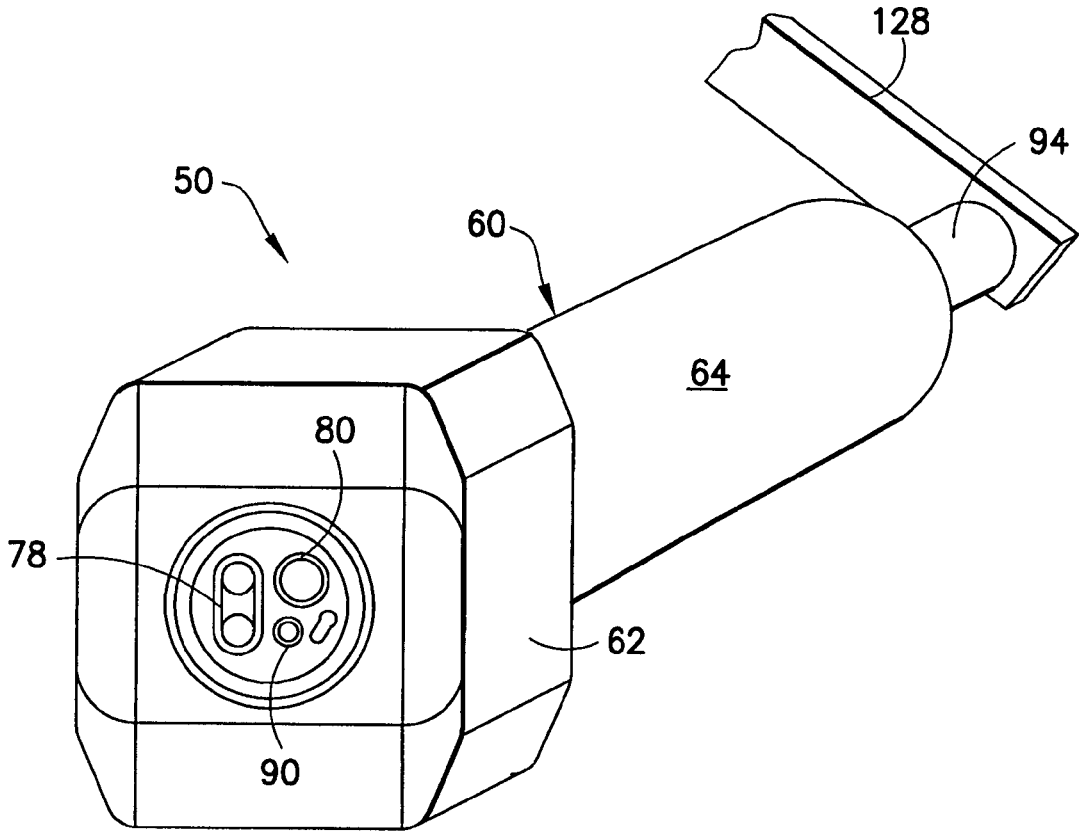
FIG. 14 is a perspective view of the further embodiment of the automatic flush assembly used in the automatic flush toilet shown in FIGS. 12 and 13.

A modification to the embodiments of the flush assembly 50 discussed hereinabove is illustrated in FIGS. 12-14. Many bowl-type toilets 10 have the handle opening 34 provided in the sidewall 35 of the holding tank 12, as illustrated in FIGS. 12 and 13. To accommodate such designs, the flush assembly 50 must be extended outward from the sidewall 35 of the holding tank 12 to enable the sensor section 54 of the flush assembly 50 to detect the presence of a person in the area 52 in front of the toilet bowl 14. The present invention further includes an extension structure or linkage 120 provided between the head portion 62 and the body portion 64 of the housing 60, which permits the flush assembly 50 to be located outward from the sidewall 35 of the holding tank 12 in bowl-type toilets 10 having side-mounted handles 36. Preferably, the extension structure 120 is adapted to permit the head portion 62 to be independently positionable relative to the body portion 64 to aim the radiation beam 73 emitted by the sensor section 54 to the area 52 in front of the toilet bowl 14, as discussed herein.

The extension structure or linkage 120 includes two link arms 122, 124 connected by an elbow joint 126. The link arms 122, 124 are preferably tubular conduits that are adapted to threadably engage the externally threaded portion 68 (see FIGS. 8 and 10) of the body portion 64 and the internally threaded portion 66 (see FIGS. 8 and 10) of the head portion 62, respectively. The first link arm 122 is thus preferably fixedly connected to the body portion 64. The first link arm 122 will have a diameter larger than the diameter of the handle opening 34 in the holding tank 12, so that the threaded engagement between the first link arm 122 and the body portion 64 both connects the head portion 62 to the body portion 64 and mounts and supports the flush assembly 50 in the handle opening 34. The second link arm 124 directly supports the head portion 62. The elbow joint 126 may be in the form of a ball joint, which will allow the second link arm 124 to move in three-dimensions (i.e., articulate) relative to the first link arm 122, which will allow the head portion 62 carrying the sensor section 54 and the control section 56 (see FIGS. 8 and 10) to move in three-dimensions (i.e., articulate) relative to the first link arm 122. Accordingly, the head portion 62 may be positioned as necessary to angle the head portion 62 so that the radiation beam 73 emitted by the sensor section 54 of the flush assembly 50 is directed toward the area 52 in front of the toilet bowl 14. The tubular structure of the link arms 122, 124 and elbow joint 126 are preferably configured to allow internal passage for the electrical wiring (not shown) connecting the sensor section 54 and the control section 56 to the actuating mechanism 58. If desired, the head portion 62 supporting the sensor and control sections 54, 56 of the flush assembly 50 may be connected to the second link arm 124 by an additional joint (not shown), such as a second ball-type joint, which will allow the head portion 62 to articulate relative to the second link arm 124. This second, preferably ball-type joint, may supplant or supplement the elbow joint 126 connecting the link arms 122, 124.

The flush assembly 50 shown in FIGS. 12-14 may be either of the flush assemblies 50 discussed previously in connection with FIGS. 7, 8 and 9, 10, respectively. The flush assemblies 50 discussed previously in connection with FIGS. 7, 8 and 9, 10 differed only in the type of actuating mechanism 58 incorporated therein. Each of the discussed flush assemblies 50 included a rotating output shaft 94, 98. In FIG. 14, the flush assembly 50 is depicted as the first embodiment of the flush assembly 50 shown in FIGS. 7 and 8 for illustration purposes only, and the flush assembly 50 shown in FIGS. 9 and 10 could be substituted therefor.

The flush assembly 50 illustrated in FIGS. 12-14 has the output shaft 94 connected by an additional link arm 128 to the existing lever arm 38 of the toilet 10. Additionally, the actuating mechanism 58 (i.e., rotary solenoid 92) is preferably adapted to rotate the output shaft 94 clockwise so that upon activation, the output shaft 94 pivots the lever arm 38 upward (i.e., clockwise), thereby raising the entire lever arm 38 upward. The link arm 128 may be connected fixedly to the lever arm 38 by any suitable mechanical means, such as through the use of mechanical fasteners and the like. Thus, in operation, once the actuating mechanism 58 is activated by the sensor and control sections 54, 56, the output shaft 94 therefrom rotates clockwise. The clockwise rotation of the output shaft 94 is transmitted to the link arm 128, which also rotates clockwise. The clockwise rotational movement of the link arm 128 will raise lever arm 38 upward, and actuate the flush valve 22 of the toilet 10. The link arm 128 is preferably secured to the lever arm 38 at approximately a midpoint thereof, (i.e., somewhere near the center of gravity of the lever arm 38) to facilitate raising the lever arm 38. It will be apparent that the foregoing discussion relating to the toilet 10 and flush assembly 50 depicted in FIGS. 12-14 is specific to a bowl-type toilet 10 having a handle opening 34 in a left-hand side, and that the flush assembly 50 may be adapted for use in a bowl-type toilet 10 having a handle opening 34 provided in a right-hand side thereof, for example, by using a counterclockwise-rotating rotary solenoid 92. Such a modification is within the skill of those skilled in the art.

The general operation of the embodiments of the flush assembly 50 discussed hereinabove is as follows. In operation, when a user approaches the area 52 in front of the toilet bowl 14, the radiation beam 73 emitted by the sensor section 54 is reflected back to the sensor section 54. If the user is positioned in the area 52 in front of the toilet bowl 14 for a sufficient period of time, the sensor section 54 provides the detection signal to the control section 56. When the user has finished using the toilet 10 and exited the area 52 in front of the toilet bowl 14, the detection signal is discontinued. The control section 56 thereafter initiates the flush signal to the actuating mechanism 58, preferably after a preset period of time has elapsed after the detection signal has been discontinued. The flush signal actuates the actuating mechanism 58 in the manner discussed previously.

Once the actuating mechanism 58 is activated, the actuating mechanism 58 rotates the lever arm 38, which places the chain 30 in tension and allows the flapper lid 24 of the flush valve 22 to be lifted from the seat 26. Water from the holding tank 12 then flows into the toilet bowl 14 through the bowl opening 28, flushing the toilet bowl 14 with water. Water will flow into the toilet bowl 14 from the holding tank 12 until the water level drops below the flapper lid 24 of the flush valve 22. Gravity then causes the flapper lid 24 to close against the seat 26 preventing further water flow into the toilet bowl 14. The holding tank 12 then refills in the conventional manner discussed previously.

The present invention provides an automatic flush toilet and, further, an automatic flush assembly that is particularly suitable for retrofitting existing bowl-type toilets typically found in private homes. The automatic flush assembly is configured specifically for mounting in the handle opening in the water holding tank of a bowl-type toilet. The automatic flush assembly may make use of an existing lever arm and chain found in the bowl-type toilet, which is the most common type of toilet found in private residences. The automatic flush assembly is easy to install, therefore requiring the homeowner to have little or no plumbing or mechanical skills to install the automatic flush assembly of the present invention.

While the present invention is described with reference to preferred embodiments of an automatic flush toilet and an automatic flush assembly, those skilled in the art may make modifications and alterations to the present invention without departing from the scope and spirit of the present invention. Accordingly, the foregoing detailed description is intended to be illustrative rather than restrictive. The invention is defined by the appended claims, and all changes to the invention that fall within the meaning and range of equivalency of the claims are to be embraced within their scope.

The invention claimed is:

1. A toilet having an automatic flushing system, comprising:

a toilet bowl;

a water holding tank for supplying water to the toilet bowl, the water holding tank defining a handle opening adapted to accept an actuating handle of the toilet;

a flush valve providing fluid communication between the toilet bowl and water holding tank, the flush valve adapted to flush the toilet bowl with water from the water holding tank upon activation; and an automatic flush assembly mounted in the handle opening, the automatic flush assembly comprising a sensor section positioned to detect the presence of a person in an area in front of the toilet bowl, a control section operatively connected to the sensor section for receiving a detection signal from the sensor indicating the presence of a person in the area in front of the toilet bowl, and an actuating mechanism adapted to actuate the flush valve in response to a flush signal from the control section, wherein the sensor section is contained within a first portion of a housing positioned exterior to the water holding tank, and the actuating mechanism is contained within a second portion of the housing extending interior to the water holding tank, the first portion and the second portion forming a unitary housing, at least a portion of the unitary housing extending through said handle opening.

2. The toilet of claim 1, wherein the actuating mechanism is connected to the flush valve by a lever arm and chain.

3. The toilet of claim 2, wherein the actuating mechanism comprises a motor-driving gearing adapted to rotate the lever arm thereby placing the chain in tension and actuating the flush valve.

4. The toilet of claim 2, wherein the actuating mechanism comprises a rotary solenoid operatively connected to the lever arm for rotating the lever arm thereby placing the chain in tension and actuating the flush valve.

5. The toilet of claim 1, wherein the sensor section comprises a radiation beam emitter for directing a radiation beam in the area in front of the toilet bowl and a radiation beam receiver for receiving a reflected radiation beam from a person located in the area in front of the toilet bowl, and wherein the control section comprises a control device which receives the detection signal from the radiation beam receiver until the detected person exits the area in front of the toilet bowl, whereupon the control device initiates the flush signal to the actuating mechanism.

6. The toilet of claim 5, wherein the control device initiates the flush signal to the actuating mechanism after a preset period of time has elapsed after the detection signal is terminated.

7. The toilet of claim 5, wherein the radiation beam transmitter and radiation beam receiver are adapted to generate and receive infrared radiation beams.

8. The toilet of claim 1, wherein the automatic flush assembly comprises a housing supporting the sensor section, control section, and actuating mechanism, the housing comprising a head portion located external to the water holding tank and a body portion located substantially internal to the water holding tank and supporting at least the actuating mechanism.

9. The toilet of claim 8, wherein the body portion of the housing defines a compartment for at least one battery used to provide electrical power to the automatic flush assembly.

10. The toilet of claim 8, wherein the head portion articulates relative to the body portion.

11. The toilet of claim 8, wherein the head portion is joined to the body portion by a threaded connection therewith.

12. The toilet of claim 1, wherein the actuating mechanism is connected to the flush valve by an existing lever arm and chain of the toilet.

13. The toilet of claim 12, wherein the actuating mechanism comprises a motor-driving gearing adapted to rotate the lever arm thereby placing the chain in tension and actuating the flush valve.

14. The toilet of claim 12, wherein the actuating mechanism comprises a rotary solenoid operatively connected to the lever arm for rotating the lever arm thereby placing the chain in tension and actuating the flush valve.

15. The toilet of claim 1, wherein the automatic flush assembly is battery-powered.

16. An automatic flush assembly for retrofitting into a handle opening of a bowl-type toilet actuated by a flush valve, the automatic flush assembly comprising a unitary housing comprising:

a sensor section for detecting the presence of a person in an area in front of the toilet;

an actuating mechanism for actuating the flush valve; and a control section operatively connected to the sensor section for receiving a detection signal from the sensor section indicating the presence of a person in the area in front of the toilet bowl, and further operatively connected to the actuating mechanism, the actuating mechanism adapted for connection to the flush valve to actuate the flush valve in response to a flush signal from the control section, wherein the sensor section is contained within a first section of the unitary housing for mounting external to a water holding tank, and the actuating mechanism is contained within a second section of the housing for mounting within the interior of the water holding tank, wherein at least a portion of said housing is adapted to extend through the handle opening.

17. The automatic flush assembly of claim 16, wherein the actuating mechanism is adapted for connection to an existing lever arm and chain of the toilet used to actuate the flush valve.

18. The automatic flush assembly of claim 17, wherein the actuating mechanism comprises a motor-driving gearing adapted for connection to the lever arm for rotating the lever arm thereby placing the chain in tension and actuating the flush valve.

19. The automatic flush assembly of claim 17, wherein the actuating mechanism comprises a rotary solenoid adapted for connection to the lever arm for rotating the lever arm thereby placing the chain in tension and actuating the flush valve.

20. The automatic flush assembly of claim 16, wherein the sensor section comprises a radiation beam emitter for emitting a radiation beam and a radiation beam receiver for receiving a reflected radiation beam, and wherein the control section comprises a control device for receiving the detection signal from the radiation beam receiver and initiating the flush signal to the actuating mechanism upon termination of the detection signal.

21. The automatic flush assembly of claim 20, wherein the control device initiates the flush signal to the actuating mechanism after a preset period of time has elapsed after the detection signal is terminated.

22. The automatic flush assembly of claim 20, wherein the radiation beam transmitter and radiation beam receiver are adapted to generate and receive infrared radiation beams.

23. The automatic flush assembly of claim 16, wherein the automatic flush assembly comprises a housing supporting the sensor section, control section, and actuating mechanism, the housing comprising a head portion to be located external to a water holding tank of the toilet and a body portion to be located substantially internal to the water holding tank and supporting at least the actuating mechanism.

24. The automatic flush assembly of claim 23, wherein the body portion of the housing defines a compartment for at least one battery used to provide electrical power for the sensor section, control section, and actuating mechanism.

25. The automatic flush assembly of claim 23, wherein the head portion articulates relative to the body portion.

26. The automatic flush assembly of claim 23, wherein the head portion is joined to the body portion by a threaded connection therewith.

27. The automatic flush assembly of claim 16, wherein the sensor section, control section, and actuating mechanism are battery-powered.

* * * * *